United States Patent [19]

Demarthe et al.

[11] 4,311,676

[45] Jan. 19, 1982

[54] PROCESS FOR THE RECOVERY OF URANIUM CONTAINED IN PHOSPHATED COMPOUNDS

[75] Inventors: Jean-Michel Demarthe, Viroflay; Serge Solar, Rambouillet, both of France

[73] Assignee: Minemet Recherche, Trappes, France

[21] Appl. No.: 17,164

[22] Filed: Mar. 2, 1979

[30] Foreign Application Priority Data

Sep. 8, 1978 [FR] France ..... 78 25815
Feb. 23, 1979 [FR] France ..... 79 4761

[51] Int. Cl.[3] ..... B01D 11/04

[52] U.S. Cl. ..... 423/10; 423/15; 423/21.5; 423/139; 423/143

[58] Field of Search ..... 423/10, 15, 21.5, 139, 423/140, 143; 210/21

[56] References Cited

U.S. PATENT DOCUMENTS

| | | | |
|---|---|---|---|
| T970,007 | 5/1978 | McCullough | 423/10 |
| 2,859,092 | 11/1958 | Bailes et al. | 423/10 X |
| 2,859,094 | 11/1958 | Schmitt et al. | 423/10 |
| 2,866,680 | 12/1958 | Long | 423/10 |
| 2,869,980 | 1/1959 | Grinstead | 423/10 |
| 2,905,526 | 9/1959 | McCullough | 423/10 |
| 2,947,774 | 8/1960 | Levine et al. | 423/10 |
| 3,835,214 | 9/1974 | Hurst et al. | 423/10 |
| 3,966,873 | 6/1976 | Elikan et al. | 423/10 |
| 4,087,512 | 5/1978 | Reese | 423/321 R |

FOREIGN PATENT DOCUMENTS

| | | | |
|---|---|---|---|
| 2064572 | 7/1971 | France | 423/10 |
| 2223466 | 11/1974 | France | 423/10 |
| 2423545 | 11/1979 | France . | |
| 42289 | 12/1959 | Poland | 423/10 |

*Primary Examiner*—Richard E. Schafer
*Attorney, Agent, or Firm*—Fleit & Jacobson

[57] ABSTRACT

This present invention provides a process of recovering uranium from a uranium-containing acid lixiviation solution comprising extracting the lixiviation solution with an organic extractant comprising an organic diluent, a dialkyl pyrophosphoric acid, and a stabilization agent, and treating the mixture of solutions as follows:

(a) bubbling anhydrous ammonia gas into the solution mixture to precipitate the ammonium salt of excess dialkyl pyrophosphoric acid; and (b) separating the precipitate from the solution and recovering the uranium from the solution.

20 Claims, 1 Drawing Figure

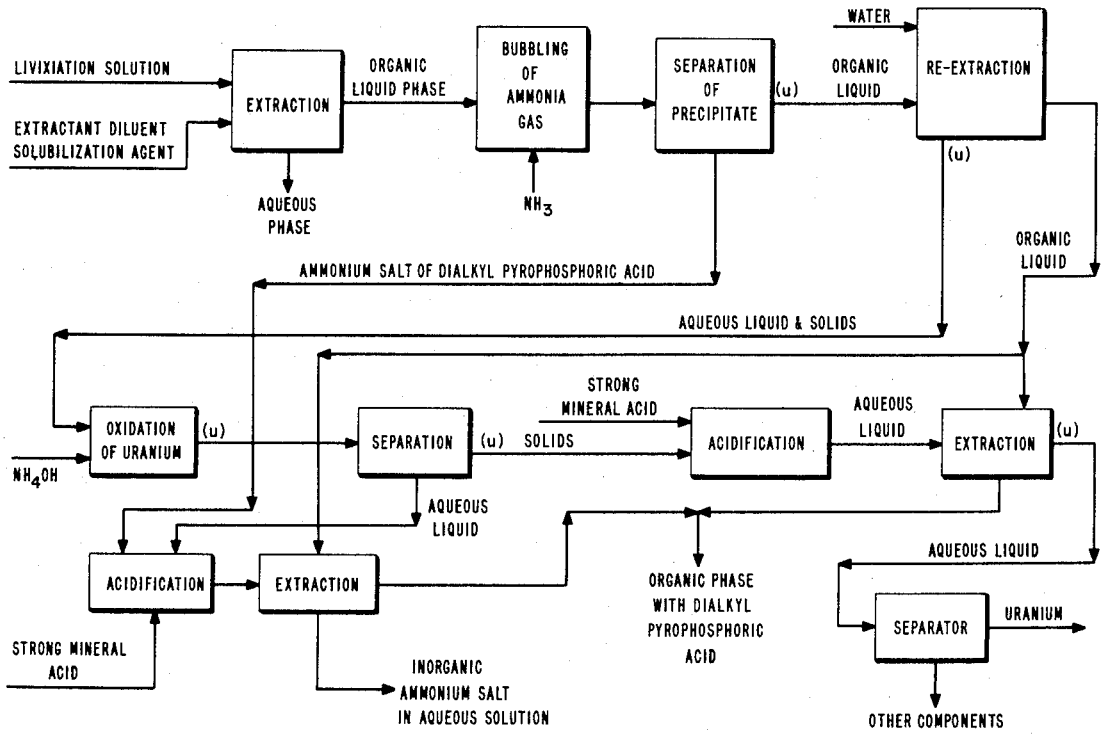

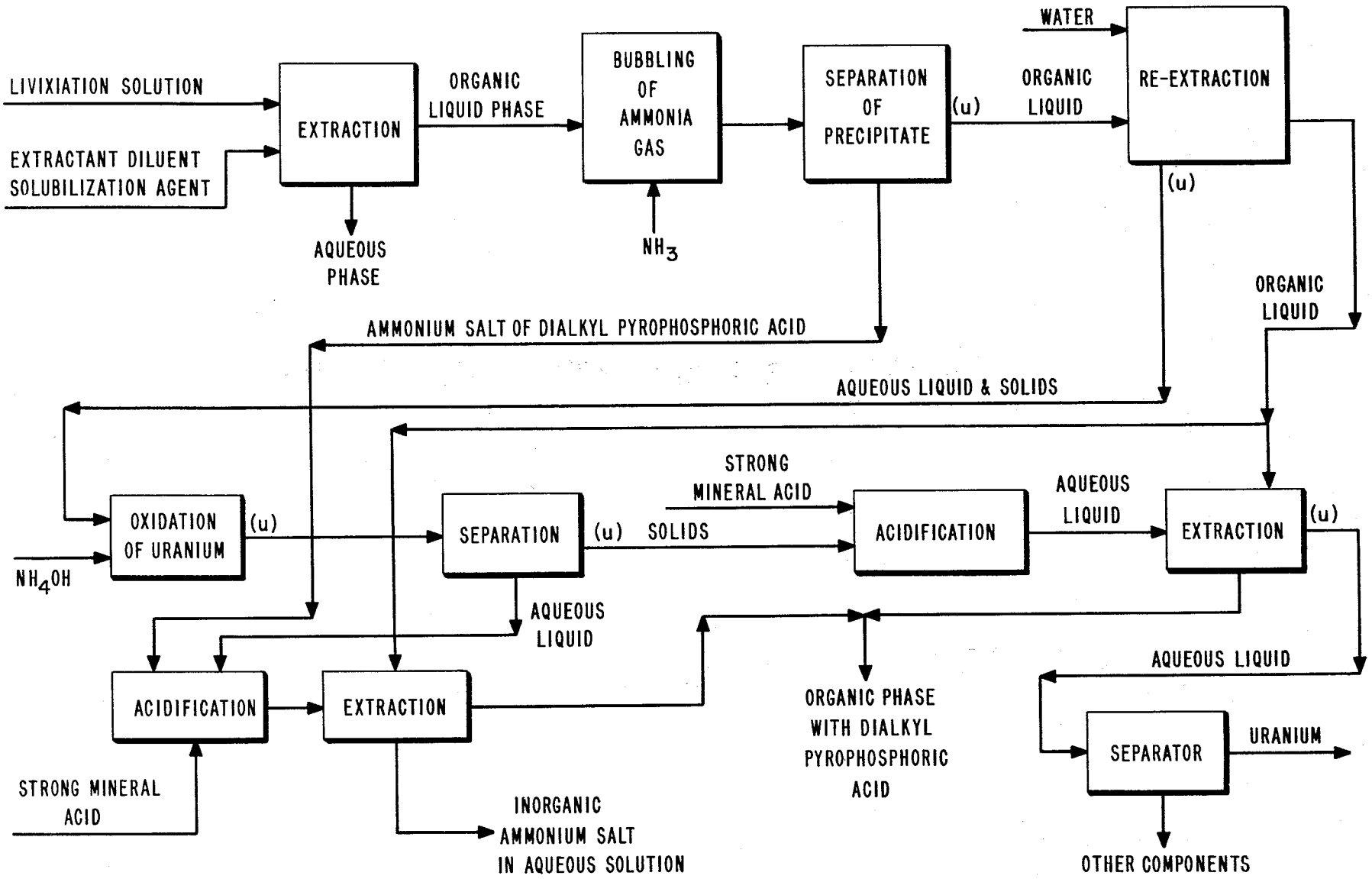
LIVIXIATION SOLUTION
EXTRACTANT DILUENT SOLUBILIZATION AGENT
EXTRACTION
ORGANIC LIQUID PHASE
AQUEOUS PHASE
BUBBLING OF AMMONIA GAS
$NH_3$
SEPARATION OF PRECIPITATE
(u)
ORGANIC LIQUID
WATER
RE-EXTRACTION
(u)
ORGANIC LIQUID
AMMONIUM SALT OF DIALKYL PYROPHOSPHORIC ACID
AQUEOUS LIQUID & SOLIDS
OXIDATION OF URANIUM
(u)
$NH_4OH$
SEPARATION
(u)
SOLIDS
AQUEOUS LIQUID
STRONG MINERAL ACID
ACIDIFICATION
AQUEOUS LIQUID
EXTRACTION
(u)
AQUEOUS LIQUID
ORGANIC PHASE WITH DIALKYL PYROPHOSPHORIC ACID
ACIDIFICATION
STRONG MINERAL ACID
EXTRACTION
INORGANIC AMMONIUM SALT IN AQUEOUS SOLUTION
SEPARATOR
URANIUM
OTHER COMPONENTS

PROCESS FOR THE RECOVERY OF URANIUM CONTAINED IN PHOSPHATED COMPOUNDS

BACKGROUND OF THE INVENTION

1. Field of Invention

The present invention relates to a process for the recovery of the uranium contained in phosphated compounds, solid or in solution. More specifically, the present invention is directed to a process for the recovery of the uranium present in an organic phase in the form of a salt of a pyrophosphoric diester.

2. Description of the Prior Art

It is known that the natural phosphates are, essentially, compounds of tricalcic phosphates which absolutely cannot be assimilated by plants, so that they cannot be used as fertilizer. This is why transforming tricalcic natural phosphates into phosphates assimilable by plants and, especially into superphosphates which constitute the widely used fertilizers, represents the heart of the activity of the phosphate industry.

The first stage of this transformation is lixiviation with an acid, usually sulfuric, which converts the tricalcic phosphate into phosphoric acid and into insoluble calcium sulfate. In addition, this lixiviation liberates the different metals such as uranium, thorium, vanadium and the rare earth metals which are trapped in phosphate deposits over the ages.

The concentration of these metals in phosphated ores is very low. Thus, for uranium, it is generally between 0.005 and 0.02%, by weight. Although these concentrations are low, because of the high market value of uranium and because of its strategic characteristics, extensive research has been conducted in the last 25 years to recover the uranium contained in acid lixiviation solutions of phosphated ores.

Among the various recovery processes which have been proposed, a particular one has found important industrial use. This process consists of submitting the lixiviation solution to a liquid-liquid extraction by means of an organic phase containing a diester of pyrophosphoric acid, which will also be called herein dialkyl pyrophosphoric acid.

This technique which is described in detail in U.S. Pat. No. 2,866,680 permits very rapid and very complete removal of the uranium present, even in very low concentrations, in different types of solutions.

However, in spite of the advantages, there are serious drawbacks in this process. The pyrophosphates hydrolyze very rapidly, which necessitates frequent regeneration of the organic phase, thus raising the cost in using this process. Also, the pyrophosphate-uranium complex is so stable that it requires a very powerful reagent to reextract the uranium.

Thus, until now experiments of elution in an alkaline medium have not permitted the regeneration of the pyrophosphoric ester and have generally led to the precipitation of an organic pyrophosphate of uranium which had to be calcined in order to eliminate all organic traces.

Until recently, only the use of hydrofluoric acid gave appreciable results for this reextraction. However, the use of this acid on one hand accelerates considerably the hydrolysis of the pyrophosphates, with all the drawbacks that entail and which have been mentioned above, and on the other hand, requires the use of very costly materials because of the toxic and corrosive characteristics of hydrofluoric acid.

An additional drawback of the above-mentioned process lies in the fact that the diesters of pyrophosphoric acid are not very selective, so that they extract, in addition to uranium, an important part of the other metals trapped in the phosphates. Upon reextraction, these metals are also precipitated by the hydrofluoric acid and they make the uranium fluoride so obtained very impure.

An important step forward in the recovery of the uranium contained in phosphated solutions is described in French patent application No. 77-25899 submitted by the present assignee. Nevertheless, this process requires the application of material which is relatively expensive because of the colloidal nature of the precipitates and the relative difficulty of separating the liquid, aqueous, or organic phases from the solid phases. The colloidal nature of the precipitates is essentially due to their impregnation by compounds of dialkyl pyrophosphoric acid.

SUMMARY OF THE INVENTION

Accordingly, it is one of the objectives of the present invention to provide a new process for the recovery of the uranium present in phosphated compounds by means of an organic phase containing a dialkyl pyrophosphoric acid, a process in which the consumption of this latter material is strongly decreased compared with presently known processes.

Another objective of this invention is to provide a process for the reextraction of the uranium present in an organic phase which contains a diester of pyrophosphoric acid, and this process avoids the use of hydrofluoric acid.

An additional objective of this invention is to provide a new process for the recovery of the uranium contained in phosphated solutions which permits easy operation for liquid-solid and liquid-liquid separation of the salts obtained and which reduces the impregnation of the latter by the compounds of dialkyl pyrophosphoric acid.

DETAILED DESCRIPTION OF THE INVENTION

These objectives, as well as others which will appear in due course, are attained by extracting the uranium-containing acid lixiviation solution with an organic phase containing a diluent, a dialkyl pyrophosphoric acid, and at least 0.5 mole of a solubilization agent for the double dialkyl pyrophosphate of uranium and ammonium per mole of dialkyl pyrophosphoric acid, and applying the following steps:

(a) bubbling anhydrous ammonia gas into the organic phase, which has been previously charged with uranium, to precipitate the ammonium salt of excess dialkyl pyrophosphoric acid;

(b) carrying out a liquid-solid separation to separate from the organic phase the ammonium salt of the dialkyl pyrophosphoric acid precipitated in step (a).

The alcoholic chains (i.e. alkyl) of the dialkyl pyrophosphoric acid specified above may be linear or branched. They may also include functions other than the alcohol function and, specifically, they may have one or several other functions. As alcohols susceptible of being esterified to give dialkyl pyrophosphates having one or several ether functions, one may cite the

BEST AVAILABLE COPY alcohols obtained by the condensation of a heavy alcohol such as that defined below, with an alkylene oxide, such as ethylene or propylene oxide. By the expression "heavy alcohol" used above, it is meant an alcohol whose alkyl radical includes from 4 to 20 carbon atoms and preferably from 6 to 12 carbon atoms.

As a diester of pyrophosphoric acid, one may, in particular, use dicapryl pyrophosphoric acid, or dioctyl pyrophosphate which will sometimes be referred to by the abbreviation: "OPPA" (octyl pyrophosphoric acid).

As to the condensation of the above-defined alcohols with phosphoric anhydride $P_2O_5$, a condensation which leads to the pyrophosphates used in the process according to the present invention, it may be carried out according to the method described in U.S. Pat. No. 2,947,774.

On the other hand, research which has lead to the present invention has shown that one could choose, as solubilization agent, liposoluble compounds which have electronic doublets susceptible of giving hydrogen bonds with the diesters of pyrophosphoric acid. Among these compounds, one may mention such trialkyl phosphates as, for example, tributyl phosphate, which will sometimes be referred to by the abbreviation: "TBP" (tributyl phosphate), the oxides of trialkylphosphine as, for example, trioctylphosphine oxide, and the heavy alcohols defined above.

These compounds also increase the pyrophosphates' resistance to hydrolysis.

Preferably, the organic phase contains from about one to five moles, more preferably from about 2 to 4 moles, of a solubilization agent per mole of dialkyl pyrophosphoric acid. Examples of the preferred solubilization agents include the primary and secondary alcohols which follow: pentanol, hexanol, heptanol, octanol, nonanol, decanol, undecanol, dodecanol, with heptanol 1 and 2, octanal 1 and 2, nonanol 1 and 2 and decanol 1 and 2 being preferred.

It may also be mentionned that it is more convenient to use as solubilization agent the same alcohol as the one condensed with phosphoric anhydride to form the dialkyl pyrophosphoric acid.

The pressure in which the invention may be carried out is preferably atmospheric pressure for reasons of simplicity.

The temperature must not be higher than about 50° C.; otherwise, the dialkyl pyrophosphoric acid hydrolyzes very rapidly. Thus, the present process is preferrably carried out within a temperature range of from about 15° to about 30° C.

The concentration of dialkyl pyrophosphoric acid in the organic phase is preferably between 1 and 10% in weight, the rest of this phase being composed of the solubilization agent and organic diluent which is chosen from those well known in the art, such as kerosene and dodecane.

Uranium is charged into the organic phase mentioned above either by contacting the organic phase with a uranium-bearing aqueous acid solution of phosphate whose pH is lower than or equal to about 2 and preferably lower than or equal to about 1, or by solid-liquid extraction of a uranium-bearing phosphated compound, such as a phosphate ore, for example. The volume ratio of acid solution to the organic extractant solution is from about 1 to about 200, preferably from about 1 to about 50.

Before the application of step (a), it is advantageous to check to see if the concentration of water in the organic phase is sufficiently low, that is, if it is lower than one part per thousand by weight, preferably from about 92 to about 0.5 per thousand by weight. If this concentration is too high, it is desirable to dry the organic phase so as to lower the water concentration to below the concentration limit, either by centrifugation or any physical means for eliminating water suspended in the organic phase or by contacting the organic phase with one of the following dehydration agents: (no exhaustive list)

anhydrous calcium sulfate;
calcium chloride;
alumina;
silica gel;
molecular sieve.

The gaseous ammonia added in the aqueous phase in step (a) must be in a quantity at least equal to the quantity necessary for transforming the dialkyl pyrophosphoric acid in excess into its double salt of ammonium. The excess ammonia does not remain in the organic phase and is released into the atmosphere. It is preferred, therefore, to economize on this costly reagent, by limiting the quantity of ammonia introduced. A satisfactory application consists in choosing, as the quantity of ammonia added in the course of step (a), two to five moles of ammonia per mole of dialkyl pyrophosphoric acid.

The time duration of step (a) is advantageously set between about one half hour and about two hours, and preferably about one hour.

Step (b) may be carried out by filtration, cycloning, or centrifugation.

The present invention rests in part on the discovery that the colloidal and/or viscous nature of the precipitates obtained in the course of the reextraction of the uranium was due to the presence of excess dialkyl pyrophospheric acid, that is, not linked to a uranium atom in the organic phase.

The purpose for steps (a) and (b) is to eliminate the excess dialkyl pyrophosphoric acid in the organic phase and to recover it in a solid form. This dialkyl pyrophosphoric acid, in the form of an ammonium salt, is not subjected to the reextraction stage and may be directly recycled to the stage of treatment of the phosphated compounds to extract the uranium therefrom. Thus, an important part of the dialkyl pyrophosphoric acid is not subjected to conditions which would facilitate its hydrolysis.

Thus steps (a) and (b) permit substantial savings of reagent and this is the case even if the following stages of reextraction of the uranium facilitate the hydrolysis of the dialkyl pyrophosphoric acid.

The introduction of steps (a) and (b) into the above-described process of reextraction with hydrofluoric acid permits therefore a substantial saving of reagents.

The process for the recovery of uranium contained in phosphated solutions described in the above-mentioned French patent application includes the steps of: (1) contacting the uranium-bearing phosphated solution of the beginning step with an organic phase containing one diester of pyrophosphoric acid, and (2) contacting the uranium-charged organic phase obtained in (1) with an alkaline solution. Between these two steps, one may easily insert process steps (a) and (b) of the present invention. Applied to the earlier process, the present steps decrease notably the consumption of dialkyl pyrophosphoric acid and greatly facilitate the subsequent operations of recovery of the uranium, the actinides and

BEST AVAILABLE COPY the rare earths, as well as the dialkyl pyrophosphoric acid entailed by the uranium.

Nevertheless, according to a preferred application of the present invention, the organic phase coming from step (b) is treated according to the following:

(c) contacting the liquid phase from step (b) with an aqueous phase (water) whose volume is between about 0.5 and about 10% of that of the organic phase, and preferably between about 1 and about 2%, then separating the organic phase from the aqueous and solid phases.

Taking into account the duration of the contact (from about 15 minutes to about an hour) and of the fact that no precaution is taken to avoid the oxidation of uranium IV into uranium VI, it has not been necessary until now to foresee the presence of an oxidation agent in the aqueous phase of step (c). Nevertheless, it is possible to add to this aqueous phase such an oxidation agent.

As the oxidation agent, one may use chlorine, hypochlorites, chlorates and, in a more general manner, all the oxidation agents whose normal apparent potential is higher than 300 millivolts compared to the hydrogen electrode. It is appropriate to point out however that it is preferable to use hydrogen peroxide, persulfates, as well as materials which produce hydrogen peroxide upon coming in contact with water as, for example, oxylith. The amount of the oxidizing agent in water ranges from about 1.5 QS to about 4 QS, preferably from about 1.5 QS to about 3 QS (QS stands for stochiometrical quantity for oxidizing uranium IV present in the organic phase in uranium VI).

According to a preferred embodiment of the invention, the process includes the following additional step:

(d) treating the aqueous and solid phases obtained in step (e) with alkalin solition, preferably ammonia solution.

Advantageously, this is carried out so that the pH obtained after the addition of ammonia is between about 8 and 10, and preferably between 9 and 10.

To attain these pH values and to obtain good solubilization of the dialkyl pyrophosphoric acid, it is preferable that the amount of ammonia added in step (d) be equal to a value between about one and four moles per gram of phosphorus contained initially in the aqueous and solid phases obtained in step (c), with the concentration of the ammonia used being advantageously between about 1 and 4 N, and, preferably, between about 1.5 and 2.5 N.

The treatment in step (d) lasts preferably from about 30 minutes to up to about two hours. During this treatment, the oxidation of the uranium IV into uranium VI continues if it was not complete after step (c). An oxidation agent may be added in the course of this step. Useful oxidizing agents include those mentionned above. The amount of the oxidizing agent added ranges from about 1.5 QS to about 4 QS, preferably from about 1.5 QS to about 3 QS. based on the total weight of the solid and liquid phases from step (c).

According to another preferred application of the invention, the process includes the following additional step:

(e) separating the liquid and solid phases present in the reaction mixture obtained in step (d).

Step (e) may be carried out by filtration, cycloning, or preferably centrifugation.

The liquid phase so obtained may be advantageously treated in the following manner:

(f) combining the liquid phase obtained in step (e) and the solid phase obtained in step (b), and thereafter acidifying the mixture thus obtained with a sufficient amount of a strong mineral acid so that the pH of the mixture is from about 2 to about-1, preferably from about 1 to about 0;

(g) extracting the reaction mixture from step (f) with at least a part of the organic phase coming from step (c) to obtain, on one hand, an organic phase charged with dialkyl pyrophosphoric acid and, on the other hand, an ammonium salt solution of the strong acid used in step (f).

In step (f), the strong mineral acid used may be one of the known strong mineral acids with the exception of those whose redox potential is sufficient to react with and oxidize the dialkyl pyrophosphoric acid. It is, therefore, preferred to avoid the use of nitric acid.

Because of the high commercial value of ammonium phosphates, the preferred strong mineral acid is phosphoric acid.

The solid phase obtained in step (d) and separated in step (e) is preferably treated in accordance with the following steps:

(h) redissolving the solid phase of step (e) with a strong mineral acid;

(i) contacting the reaction mixture of step (h) with an organic solution to reextract the dialkyl pyrophosphoric acid, the volume ratio of the mixture to the organic solution being from about 0.5 to about 4, preferably from about 0.5 to about 1.5;

(j) treating the residual aqueous phase to recover therefrom the iron as well as uranium, the actinides and the rare earths.

Preferably the organic solution applied in step (i) has a composition identical to that issuing from step (c) or may even be a fraction thereof. The fraction ranges from about 2 to about 10.

After re-extraction of the dialkyl pyrophosphoric acid in step (i) the organic phase is advantageously recycled to the extraction step at the beginning of the process.

The drawing provides a flow chart showing various stages in uranium separation, and combines many of the embodiments of the invention. The drawing shows all of the operations presented in the claims which follow. Further, "(U)" indicates the stream which contains the bulk of the uranium after certain of the operations.

The following examples, which are non-limiting, are provided to further illustrate the present invention.

The following examples are divided into two parts. The first part is for purposes of comparison whereas the second part exemplifies the present invention.

EXAMPLE 1

Reextraction of the uranium and iron from a uranium charged organic phase not containing octanol (3% OPPA+97% kerosene)

Kinetic study of the precipitation of the dialkyl pyrophosphoric acid, of uranium and of iron. Operative method:

Into an organic phase charged with uranium, ammonia is bubbled at a flow rate of 25 liters per hour. Specimens of the organic phase are removed for analysis after 5 minutes, 15 minutes, 30 minutes, and 60 minutes of reaction. At the time when the last specimen is taken, the reaction is stopped and the reaction mixture centrifuged for a period of 60 minutes at 2100 rpm. The centrifugation apparatus RUNNE is used
Results:

| Composition of the organic phase | | | |
|---|---|---|---|
| Time (minutes) | U mg/l | Fe mg/l | P mg/l |
| 0 | 830 | 193 | 3500 |
| 5 | 32 | 6 | <200 |
| 15 | 29 | 7 | <200 |
| 30 | 34 | 7 | <200 |
| 60 | 50 | 9 | <200 |
| 60 + centrifugation | 140 | 26 | <200 |

It is seen that after 5 minutes of bubbling, the majority of the uranium, iron, and phosphorous is in the precipitate. By increasing the duration of the reaction, the uranium and the iron already precipitated are partially redissolved. The phenomenon is even more marked after one hour of centrifugation.

EXAMPLE 2

Reextraction of uranium and iron from a uranium charged organic phase containing octanol (3% OPPA+3% octanol+94% kerosene)

Kinetic study of the selective precipitation of excess dialkyl pyrophosphoric acid.
Operative method:

Into an organic phase charged with uranium, ammonia is bubbled at a flow of 25 liters per hour. Specimens are removed from the organic phase for anlaysis after 5 minutes, 10 minutes, 15 minutes, 30 minutes, 60 minutes, and 90 minutes. At the same time as the last specimen is collected, the reaction is stopped and the reaction mixture centrifuged for a period of 60 minutes at 2100 rpm.
Results:

| Composition of the organic phase | | | |
|---|---|---|---|
| Time (minutes) | U g/l | Fe mg/l | P g/l |
| 0 | 1.12 | 220 | 3.50 |
| 5 | 1.13 | 215 | 2.32 |
| 10 | 1.13 | 205 | 1.80 |
| 15 | 1.13 | 205 | 1.68 |
| 30 | 1.17 | 215 | 1.66 |
| 60 | 1.13 | 210 | 1.64 |
| 90 | 1.08 | 215 | 1.61 |
| 90 + centrifugation | 1.15 | 215 | 1.58 |

In contrast to the results of Example 1, the uranium and iron remain in solution while the phosphorus is precipitated in part. The concentration of the phosphorus in the organic phase initially decreases rapidly from 3.5 to 1.7 g/l after 15 minutes of reaction, and then, very slowly.

EXAMPLE 3

Behavior of the precipitate of Example 2

After 90 minutes of reextraction and 60 minutes of centrifugation, the following are collected:
organic phase: 740 ml
precipitate: 49 g
The precipitate is divided into two parts, one part being treated with water, and the other with 2 N ammonia solution.
3.1. Water and precipitate.
Operative conditions:
Precipitate: 24.5 g
$H_2O$: 100 ml
duration of agitation: 30 minutes at 30° C.
duration of centrifugation: 60 minutes
Results:

| Composition of the precipitate | | | | | | | |
|---|---|---|---|---|---|---|---|
| Precipitate | Moist Weight g | Dry Weight g | Humidity % | U | Fe | P | Observations |
| Interface | 1.70 | 0.10 | 94 | ND | ND | ND | All the precipitate remains in the interface |

ND: not determined.

| Composition of the aqueous phase | | | | | |
|---|---|---|---|---|---|
| | Volume ml | U mg/l | Fe mg/l | P g/l | Observations |
| aqueous phase | 105 | 253 | 16 | 7.70 | aqueous phase, whitish pH = 8.5 (20° C.) |

3.2 2N Ammonia solution and precipitate.

The operative conditions are identical to those of Example 3.1, but the water is replaced by 100 ml of ammonia solution.
Results:

| Composition of the precipitate | | | | | | | |
|---|---|---|---|---|---|---|---|
| Precipitate | Moist Weight g | Dry Weight g | Humidity % | U | Fe | P | Observations |
| Interface | 1.04 | 0.06 | 94 | ND | ND | ND | All the precipitate remains in the interface |

ND: not determined

| Composition of the aqueous phase | | | | | |
|---|---|---|---|---|---|
| | Volume ml | U mg/l | Fe mg/l | P g/l | Observations |
| aqueous phase | 105 | 125 | 13 | 7.15 | aqueous phase, whitish pH = 10.3 (20° C.) |

The precipitate is composed primarily of ammonium salts of OPPA which are soluble in water and in diluted ammonia solution.

EXAMPLE 4

Elution and precipitation of uranium contained in the organic phase after the treatment of Example 2

4.1. Influence of amounts of $H_2O_2$ and of $H_2O$ on reextraction.

The organic phase is divided into four equal volumes which are submitted to a second reextraction under different conditions. Common operative conditions:
Organic phase: 185 ml
Flow rate: 5 l/h
duration: 1 hour
The amounts of hydrogen peroxide and of water used vary according to the experiments.

| Composition of the organic phase | | |
|---|---|---|
| Experiments | $H_2O_2$ introduced ml/l | $H_2O$ introduced ml/l |
| 1 | 1 | 0 |

-continued

| | | |
|---|---|---|
| 2 | 3 | 0 |
| 3 | 1 | 5 |
| 4 | 1 | 10 |

| | Composition of the organic phase | | | | |
|---|---|---|---|---|---|
| Experiments | Volume Organic phase ml | U g/l | Fe mg/l | P g/l | Weight moist precipitate (g) |
| 1 | 174 | 1.5 | 200 | 1.07 | 1.25 |
| 2 | 174 | 0.875 | 165 | 1.02 | 2.65 |
| 3 | 180 | 0.510 | 115 | 0.99 | 1.51 |
| 4 | 172 | <0.005 | <10 | <0.2 | 5.01 |

In experiments 3 and 4, the precipitation takes place approximately 2 minutes after the beginning of the bubbling of the ammonia. But in experiment 3, redissolution of a large portion of the precipitates already formed is noticed as the reaction time is prolonged. The organic phase changes from yellow to colorless and then yellow again after one hour of reaction.

Conclusion:

These results show that hydrogen peroxide alone does not permit a complete reextraction of the uranium and iron contained in the organic phase. It is the amount of water introduced and the duration of the injection of ammonia that permits the uranium and iron to be totally precipitated. It is nevertheless necessary to determine the minimal amounts of water and ammonia needed for total reextraction. The use of an excess of one of these amounts could diminish the rate of reextraction. It also appears that the use of hydrogen peroxide to oxidize uranium IV into uranium VI at the time of the second reextraction is not necessary in view of the intense yellow color of the organic phase which is characteristic of uranium.

4.2. Behavior of various precipitates obtained at the time of treatment with water.

Operative conditions: precipitate of variable weight $H_2O$: 37 ml (200 ml/l organic phase)

Duration of agitation: 30 minutes at 30° C.

Duration of centrifugation: 1 hour.

Results:

| | Composition of the aqueous phase | | | |
|---|---|---|---|---|
| Experiment | Volume ml | U mg/l | Fe mg/l | P g/l |
| 1 | 37 | 25 | <5 | 0.17 |
| 2 | 37 | 32 | <5 | 0.66 |
| 3 | 35 | 19 | <5 | 0.41 |
| 4 | 33 | 1600 | 148 | 3.60 |

| | Composition of the precipitate | | | | | |
|---|---|---|---|---|---|---|
| Experiment | Moist Weight g | Dry Weight g | Humidity % | U % | Fe % | P % |
| 1 | <0.1 | | | | | |
| 2 | 1.43 | 0.11 | 92 | | | |
| 3 | 1.10 | 0.08 | 93 | | | |
| 4 | 4.12 | 0.49 | 88 | 22.2 | 3.89 | 9.99 |

Observations:

All the aqueous phases obtained are cloudy, particularly that of experiment 4, which is milky. In experiments 1, 2, and 3, all the precipitates remain at the interface of the organic and aqueous phases. In experiment 4, the precipitate is found in the centrifugation residue but in all of the experiments traces of precipitate are found trapped in a gelatin bed at the interface of the organic and aqueous phases.

Conclusion:

It is observed that there is partial redissolution of uranium, iron and phosphorus after treating the precipitate with water. But the precipitates obtained are much richer in uranium (22.2% in experiment 4) and are soluble in normal sulfuric acid.

EXAMPLE 5

Continuous experiment

A complete continuous experiment applying steps (a) through (j) of the process according to the present invention is conducted with extraction of a uranium-bearing phosphated solution. The organic phase charged with dialkyl pyrophosphoric acid of step (g) is recycled to extraction of the uranium-bearing phosphated solution.

The summary shown in the table is based on a flow rate of 1 $m^3$/hr of the uranium charged organic phase.

The initial organic phase has the same composition as that of Example 2 (3% of OPPA, 3% octanol, 94% kerosene).

| | | Composition | | | Concentration |
|---|---|---|---|---|---|
| | Flow rate $m^3$/hr | Uranium | Fe | Phosphorus | |
| Phosphated uranium-bearing solution | 10 $m^3$ | | | | |
| Organic phase charged in uranium before step (a) | 1 $m^3$ | 1.14 g/l | 0.22 g/l | 3.60 g/l | |
| Ammonia used in step (a) (gas) | 5 $m^3$ | | | | |
| Organic phase recycled in step (i) to first extraction step | 0.04$m^3$ | 6.5 g/l | 1.5 g/l | 4.2 g/l | |
| Precipitate coming from (b) | 65 kg | 0.12% wt | 0.02% wt | 3% wt | |
| Organic phase coming from (b) | 0.95 $m^3$ | 1.12 g/l | 0.22 g/l | 0.61 g/l | |
| Organic phase coming from (c) | 0.95 $m^3$ | 1.02 g/l | 0.005 g/l | 0.02 g/l | |
| Organic phase coming from (c) recycled to (g) | 0.91 $m^3$ | 0.02 g/l | 0.005 g/l | 0.02 g/l | |
| Organic phase coming from (c) recycled to (i) | 0.04 $m^3$ | 0.02 g/l | 0.005 g/l | 0.02 g/l | |
| Water added to step (c) | 0.01 $m^3$ | | | | |
| Precipitate obtained at step (c) | 0.01 $m^3$ | 1.04 kg | 0.21 kg | 1.59 kg | |
| Ammonia added in (d) | 0.4 $m^3$ | | | | |
| Aqueous phase obtained at step (c) | 0.4 $m^3$ | 0.160 g/l | 0.02 g/l | 3 g/l | |
| Strong acid used in step (f) ($H_3PO_4$) | 0.1 $m^3$ | | | | |
| OPPA supply to compensate losses before recycl. toward uranium-bearing phos- | | | | | |

-continued

| | Flow rate $m^3/hr$ | Composition Uranium | Fe | Phosphorus | Concentration |
|---|---|---|---|---|---|
| phated solution to be extracted | 2.9% vol | | | | |
| Solid phase obtained in (e): | | | | | |
| humid | 30 kg | | | | |
| dry | 3 kg | 35.2% wt | 6% wt | 8.9% wt | |
| Acid introduced in (h) (sulfuric acid) | 0.06 $m^3$ | | | | 1N |
| Aqueous phase coming from (i) | 0.085$m^3$ | 9.3 g/l | 1.6 g/l | 1.2 g/l | |

Conclusions:

This example shows that the percentage of OPPA which is precipitated selectively in the form of ammonium salt by the injection of gaseous ammonia is 54.2%.

The addition of water in step (c) causes the precipitation of 98.1 wt% of the uranium contained in the initial organic phase.

According to this experiment, the uranium is recovered in the form of "yellow-cake" with a return on the order of 94%.

It is also observed that at the time of the sulfuric acid dissolution, about 75% of the uranium is found again in the organic phase and about 25% in the aqueous phase.

URANIUM EXTRACTION FROM PHOSPHATE SOLUTION

It has been shown above that it was advisable to stabilize and dissolve the diester of the pyrophosphoric acid, or dialkyl pyrophosphoric acid, using dissolving and stabilising agents. These agents must be liposoluble components showing electronic doublets liable to produce hydrogen liaisons with the diesters of the pyrophosphoric acid. Among thoses components, one may quote the trialkyl phosphates as, for instance, the tributyl phosphate (hereafter often referred to as "TBP"), the trialkylphosphine oxides such as the trioctylphosphine oxide, and the heavy alcohols.

In the course of further investigations, it has been shown that the best suited among those agents were the heavy alcohols as defined above, i.e. alcohols with an alkyl radical that comprises 4 to 20 and preferably 6 to 12 atoms of carbon.

It has also been shown that these agents should preferably figure in a ratio of at least 0.5 mole per mole of dialkyl pyro phosphoric acid.

Nevertheless, the use of such agents generally entails an antisynergetic effect towards the extraction power of dialkyl pyrophosphoric acids, either directly or in so far as the stabilising agents tend to favour the extraction of the iron present in the phosphate solutions as compared with that of uranium. This adverse effect is a nuisance when extracting uranium out of phosphate solutions with an iron concentration of 1 to 30 grams per liter and particularly when the iron concentration exceeds 5 grams per liter.

This is why one of the further objectives of the invention is to provide a process that favours the extraction of uranium with regard to that of iron.

Another aim of the invention is to provide a process that wholly exhausts the uranium contained in the phosphate solutions.

These aims are achieved by means of the improvement characterized by an organic phase concentration in dialkyl pyrophosphoric acid comprised between 0.1 and 0.4, preferably 0.15–0.25 M.

It should be noted that, contrary to what had been disclosed earlier, the use of dialkyl pyrophosphoric acid at such concentration levels does not give rise to troubles at extraction stage, when bringing the phosphate solution and the organic phase into contact, and that if the contact is made with a ratio of the organic to the aqueous phase (O/A) ranging from 1 to 1/50, no emulsion problem occurs. If an O/A ratio lesser than 1/50 or greater than 1/200 is wanted, emulsion problems may be avoided by extracting at a temperature above 30° C., preferably between 35° and 45° C. Besides, emulsion problems are only to be encountered whenever the reduction of the phosphate solution was not complete.

The improvement is based on the surprising fact that the ratio of extracted uranium to extracted iron notably increases with the concentration of dialkyl pyrophosphoric acid in the organic phase, and that contrary to previous theoretical investigations, the ratio of extracted uranium to dioctyl pyrophosphoric acid increases with the latter. This inconsistency is hard to understand but could be ascribed to the fact that iron was largely present in the phosphate solutions treated by the applicant, whereas there was none in the earlier theoretical studies.

It should also be noted that the presence of dissolving and stabilising agents enhances the dissolution of dialkyl pyrophosphoric acid.

One of the advantages that may also be underlined when using a high concentration of dialkyl pyrophosphoric acid is that either the constraints pertaining to the reduction of the solution are eased or the uraniferous solution of 30% phosphoric acid % is completely exhaused with relatively few extraction stages.

One may state for example that using an organic phase that contained about 0.1 mole per liter octylpyrophosphoric acid and 0.1 mole of octylic alcohol, it was possible, in four stages to extract 99% of the uranium contained in a phophate solution at 30% phosphoric acid with 10 grams per liter of iron and a ratio of iron III to total iron not exceeding 2%, 100 milligrams per liter of uranium as well as the impurities mentioned on page 5 of the main patent. It is also possible to exhaust the uranium contained in an acid whereof ratio Iron III to total Iron is high (about 90%), but it necessitate to use concentrated organic phase, e.g. organic phase with about 10% OPPA.

The non-restrictive examples quoted hereunder should facilitate the specialist's assessment of the operating conditions required for each particular case. Operating directions for the examples 6 to 10:

The trials are carried out on a batch of industrial phosphoric acid with the following mean analysis:

Fluorine: 13.7 g/l (the fluor is mainly present as $SiF_4$).

Sulphates: 33.1 g/l

Calcium: 0.98 g/l

Aluminium: 3.2 g/l $P_2O_5$: 329 g/l.

The uranium and iron content of the solution is indicated for each example.

The contacts are carried out as follows: the aqueous and organic phase are introduced in a setting ampule, the two phases are strenuously shaked for a minute. Then the phases are left to settle for 15 minutes after which they are separated and aliquots of each phase are titrated.

In the examples, the table "Exhaustion of aqueous phase" concerns the extraction of an aqueous phase brought into contact with several fresh organic phases successively, whereas the table "Upgrading of organic phase" refers to the upgrading of an organic phase by putting it into contact with a succession of fresh aqueous phases.

EXAMPLE 6

Organic phase composition:
di-octyl pyrophosphoric acid (OPPA): 3% in weight (0,074 M)
octanol-2:3% in weight
kerosen: 94%
Temperature: 40° C.

| | Exhaustion of the aqueous phase | | | | |
|---|---|---|---|---|---|
| | Organic phase | | Aqueous phase | | |
| O/A | Uranium mg/l | Iron mg/l | Uranium mg/l | Iron g/l | $Fe^{2+}$ Fet |
| | | | 125 | 12,70 | 0,96 |
| 1/50 | 1230 | 325 | 100 | 12,69 | 0,95 |
| 1/10 | 620 | 535 | 38 | 12,64 | 0,94 |
| 1/10 | 220 | 660 | 16 | 12,57 | 0,91 |
| 1/10 | 75 | 720 | 9 | 12,50 | 0,92 |
| 1/10 | 25 | 765 | 6 | 12,43 | 0,92 |
| 1/10 | <5 | 810 | 6 | 12,34 | 0,91 |

| | Up-grading of the organic phase | | | | |
|---|---|---|---|---|---|
| | Organic phase | | Aqueous phase | | |
| O/A | Uranium mg/l | Iron mg/l | Uranium mg/l | Iron g/l | $Fe^{2+}$ Fet |
| 1/2 | 215 | 655 | 17 | 12,37 | 0,95 |
| 1/10 | 865 | 440 | 60 | 12,72 | 0,95 |
| 1/10 | 1240 | 355 | 87 | 12,71 | 0,95 |
| 1/10 | 1290 | 335 | 120 | 12,70 | 0,95 |
| 1/10 | 1340 | 295 | 120 | 12,70 | 0,95 |
| 1/10 | 1240 | 310 | 135 | 12,70 | 0,95 |

EXAMPLE 7

Organic phase composition:
di-octyl pyrophosphoric acid (OPPA): 3% in weight
octanol-2:3% in weight
kerosen: 94%
Temperature: 30° C.

| | Exhausting of the aqueous phase | | | | |
|---|---|---|---|---|---|
| | Organic phase | | Aqueous phase | | |
| O/A | Uranium mg/l | Fer mg/l | Uranium mg/l | Fer g/l | $Fe^{2+}$ Fet |
| | | | 127 | 13,00 | 0,98 |
| 1/50 | 1310 | 370 | 101 | 12,99 | 0,97 |
| 1/10 | 660 | 505 | 35 | 12,94 | 0,97 |
| 1/10 | 230 | 640 | 12 | 12,88 | 0,96 |
| 1/10 | 65 | 720 | 5 | 12,80 | 0,96 |
| 1/10 | 20 | 760 | 3 | 12,73 | 0,96 |
| 1/10 | <5 | 810 | 3 | 12,65 | 0,96 |

| | Up-grading of the organic phase | | | | |
|---|---|---|---|---|---|
| | Organic phase | | Organic phase | | |
| O/A | Uranium mg/l | Iron mg/l | Uranium mg/l | Iron g/l | $Fe^{2+}$ Fet |

-continued

| | | | | | |
|---|---|---|---|---|---|
| 1/2 | 220 | 625 | 17 | 12,69 | 0,98 |
| 1/10 | 540 | 395 | 65 | 13,02 | 0,97 |
| 1/10 | 985 | 320 | 112 | 13,01 | 0,97 |
| 1/10 | 1170 | 275 | 109 | 13,00 | 0,97 |
| 1/10 | 1150 | 270 | 129 | 13,00 | 0,97 |
| 1/10 | 1140 | 260 | 128 | 13,00 | 0,97 |

EXAMPLE 8

Organic phase composition:
di-octyl pyrophosphoric acid (OPPA): 3% in weight
octanol-2: 0%
kerosen: 97%
Temperature: 30° C.

| | Exhaustion of the aqueous phase | | | | |
|---|---|---|---|---|---|
| | Organic phase | | Aqueous phase | | |
| O/A | Uranium mg/l | Iron mg/l | Uranium mg/l | Iron g/l | $Fe^{2+}$ Fet |
| | | | 126 | 13,60 | 0,97 |
| 1/50 | 1670 | 205 | 93 | 13,60 | 0,97 |
| 1/10 | 720 | 525 | 21 | 13,54 | 0,95 |
| 1/10 | 130 | 780 | 8 | 13,47 | 0,95 |
| 1/10 | 20 | 860 | 6 | 13,38 | 0,96 |
| 1/10 | <5 | 915 | 5 | 13,29 | 0,96 |
| 1/10 | <5 | 940 | 5 | 13,19 | 0,96 |

| | Up-grading of the organic phase | | | | |
|---|---|---|---|---|---|
| | Organic phase | | Aqueous phase | | |
| O/A | Uranium mg/l | Iron mg/l | Uranium mg/l | Iron g/l | $Fe^{2+}$ Fet |
| 1/2 | 235 | 775 | 8 | 13,21 | 0.97 |
| 1/10 | 1070 | 430 | 42 | 13,63 | 0,97 |
| 1/10 | 1540 | 315 | 79 | 13,61 | 0.96 |
| 1/10 | 1670 | 260 | 113 | 13,61 | 0,96 |
| 1/10 | 1770 | 240 | 116 | 13,60 | 0.96 |
| 1/10 | 1680 | 235 | 135 | 13,60 | 0,96 |

EXAMPLE 9

Organic phase composition:
di-octyl pyrophosphoric acid (OPPA): 6% in weight
octanol-2: 3% in weight
kerosen: 91%
Temperature: 30° C.

| | Exhaustion of the aqueous phase | | | | |
|---|---|---|---|---|---|
| | Organic phase | | Aqueous phase | | |
| O/A | Uranium mg/l | Iron mg/l | Uranium mg/l | Iron g/l | $Fe^{2+}$ % |
| | | | 112 | 10,20 | 1 |
| 1/50 | 3010 | 425 | 52 | 10,19 | 1 |
| 1/10 | 465 | 1070 | 5 | 10,08 | 1 |
| 1/10 | 40 | 1380 | 1 | 9,94 | 1 |
| 1/10 | <5 | 1420 | 0 | 9,80 | 1 |
| 1/10 | <5 | 1470 | 0 | 9,70 | 1 |
| 1/10 | <5 | 1490 | 0 | 9,50 | 1 |

| | Up-grading of the organic phase | | | | |
|---|---|---|---|---|---|
| | Organic phase | | Aqueous phase | | |
| O/A | Uranium mg/l | Iron mg/l | Uranium mg/l | Iron g/l | $Fe^{2+}$ % |
| 1/2 | 205 | 1170 | 9 | 9,61 | 1 |
| 1/10 | 1100 | 905 | 22 | 10,23 | 0,98 |
| 1/10 | 1950 | 705 | 27 | 10,22 | 0,97 |
| 1/10 | 2580 | 565 | 49 | 10,21 | 0,96 |
| 1/10 | 3010 | 495 | 69 | 10,21 | 0.95 |
| 1/10 | 3380 | 445 | 75 | 10,21 | 0,95 |

EXAMPLE 10

Extraction tests were carried out with extracting organic phase of various composition and with various ratios Iron II/Total Iron in the aqueous phase. The 30% phosphoric acid used presents the same composition as for examples 6 to 9. With:

Uranium: 120 mg/l

Iron: 12,8 g/l

The ratio O/A is always 1/50.

The diluant is kerogen.

| Composition of the loaded organic phase | | | Iron | |
|---|---|---|---|---|
| OPPA WE % | Octanol-2 WE % | Uranium g/l | Iron Total % | Temperature |
| 6 | 0 | 1,32 | 10 | 30° C. |
| 6 | 3 | 1,12 | 10 | 30° C. |
| 12 | 0 | 2,44 10 | 30° C. | |
| 12 | 3 | 1,88 | 10 | 30° C. |
| 12 | 3 | 1,76 | 10 | 45° C. |
| 12 | 3 | 2,41 | 50 | 30° C. |
| 12 | 3 | 2,15 | 50 | 45° C. |
| 6 | 0 | 2,7 | 98 | 30° C. |
| 6 | 3 | 2,3 | 98 | 30° C. |
| 12 | 0 | 3,97 | 98 | 30° C. |
| 12 | 3 | 3,40 | 98 | 30° C. |
| 12 | 3 | 3,11 | 98 | 45° C. |

In conclusion, this example shows clearly that it is possible to completely extract the uranium present in 30% phosphoric acid even not reduced when using organic phase with high concentration in dialkyl pyrophosphoric acid.

It is clear from this example that the extraction rate decreases when the Iron III concentration increases and that it is possible to overcome this drawback by increasing the dialkyl pyrophosphoric acid concentration.

The high concentration of the pyrophosphoric acid may entail difficulties for reextraction. These difficulties may easily be overcomed by diluting organic phase before stripping.

What is claimed is:

1. A process for recovering uranium from a uranium-containing acid lixiviation solution comprising: extracting the lixiviation solution with an organic extractant solution comprising a dialkyl pyrophosphoric acid, a diluent, and at least 0.5 mole of a solubilization agent for the double dialkyl pyrophosphate of uranium and ammonium which is present at any point during the process per mole of dialkyl pyrophosphoric acid, and treating the resulting mixture of solutions as follows:

(a) bubbling anhydrous ammonia gas into the loaded organic solution to precipitate the ammonium salt of the excess dialkyl pyrophosphoric acid, and (b) separating the precipitate of step (a) from the uranium-containing liquid phase and recovering uranium from the liquid phase.

2. The process of claim 1 wherein the organic solution comprises from about 2 to about 5 moles of the solubilization agent per mole of dialkyl pyrophosphoric acid.

3. The process of claim 1 wherein the organic solution comprises from about 1 to about 10% by weight of dialkyl pyrophosphoric acid, from about 2 to about 5 moles of the solubilization agent per mole of dialkyl phosphoric acid, and the balance being the diluent.

4. The process of claim 3 wherein the dialkyl pyrophsophoric acid is dioctyl pyrophosphoric acid, the stabiliation agent is octanol-2, and the diluent is kerosene.

5. The process of claim 1 wherein prior to the application of ammonia in step (a), the mixture of solution is dried by contacting the mixture with a dehydration agent selected from the group consisting of anhydrous calcium sulfate, calcium chloride, alumina, silica gel, and molecular sieve, so that the water content of the mixture is less than 1 part per thousand by weight.

6. The process of claim 1 wherein the amount of ammonia added in step (a) is at least equal to the quantity necessary for transforming the excess dialkyl pyrophosphoric acid into its double ammonium salt.

7. The process according to claims 1, 2, 3, 4, or 5 wherein the amount of ammonia added is from about 2 to about 5 moles per mole of excess dialkyl pyrophosphoric acid.

8. The process of claim 1 wherein the extraction and steps (a) and (b) are conducted at a pressure of about 1 atmosphere and a temperature of not higher than about 50° C.

9. The process of claim 1 wherein step (b) is performed by filtration, cycloning, or centrifugation.

10. A process of recovering uranium from an aqueous uranium-containing acid lixiviation solution comprising: extracting the solution with an organic extractant solution comprising a diluent, a dialkyl pyrophosphoric acid, and at least one mole of a solubilization agent for both of the dialkyl pyrophosphorate of uranium and ammonium which is present at any point during the process per mole of dialkyl pyrophosphoric acid, and treating the resulting mixture of solutions as follows:

(a) bubbling into the mixture of solutions anhydrous ammonia gas to precipitate the ammonium salt of the excess dialkyl pyrophosphoric acid;

(b) separating the precipitate of step (a) from the uranium-containing liquid phase;

(c) contacting the liquid phase of step (b) with water, the volume of which is from about 0.5 to about 10% of that of the liquid phase from step (b) for from about 15 minutes to about 1 hour, and separating the organic phase from the aqueous and solid phases;

(d) treating the aqueous and solid phase from step (c) with ammonia until the pH of the solid-liquid phases is from about 8 to about 10;

(e) separating the aqueous liquid and solid phases obtained in step (d);

(f) combining the liquid phase from step (e) and the solid phase obtained in step (b) and acidifying with a strong mineral acid selected from the group consisting of sulfuric acid and phosphoric acid so that the pH of the resulting mixture is from about −1 to about 2;

(g) extracting the mixture of step (f) with a portion of the organic phase obtained in step (c) to form an organic phase charged with dialkyl pyrophosphoric acid and an ammonium salt solution of the acid used in step (f);

(h) redissolving the precipitate obtained in step (e) with a strong mineral acid selected from the group consisting of sulfuric acid and phosphoric acid;

(i) contacting the resulting mixture of (h) with an organic solution to reextract the dialkyl pyrophosphoric acid, the organic solution having a composition identical to that obtained in step (c) and the volume ratio of the mixture to the organic solution being from about 0.5 to about 4;

(j) treating the aqueous phase from step (i) to recover therefrom uranium, iron, the actinides and rare earth metals.

11. The process of claim 10 wherein prior to step (a), the mixture of solution is contacted with a dehydration agent selected from the group consisting of anhydrous calcium sulfate, calcium chloride, alumina, silica gel, and molecular sieve, so that the water content in the mixture is lower than 1 per 1000 by weight.

12. The process of claim 10 wherein in step (a), the amount of ammonia bubbled into the mixture of solution is at least equal to the quantity necessary for transforming the excess dialkyl pyrophosphoric acid into its double ammonium salt.

13. The process of claim 12 wherein in step (a), the amount of ammonia added is from about 2 moles to about 5 moles per mole of dialkyl pyrophosphoric acid.

14. The process of claim 10 wherein the organic extractant solution comprises from about 2 to about 5 moles of the solubilization agent per mole of dialkyl pyrophosphoric acid.

15. The process of claim 10 wherein the organic solution comprises from about 1 to about 10% by weight of dialkyl pyrophosphoric acid, from about 2 to about 5 moles of the solubilization agent per mole of dialkyl phosphoric acid, and the balance being the diluent.

16. The process of claim 15 wherein the dialkyl pyrophosphoric acid is dioctyl pyrophosphoric acid, the stabilization agent is octanol-2, and the diluent is kerosene.

17. The process of claim 10 wherein in step (c) the liquid phase of step (b) is contacted with water and an oxidizing agent, the amount of oxidizing agent in the water ranging from about 1.5 QS to about 4 QS.

18. The process of claim 17 wherein in step (d), an oxidizing agent is added to the solid and liquid phases, the amount of oxidizing agent added being from about 1.5 QS to about 4 QS.

19. The process of claim 10 wherein a fraction of the organic phase from step (c) is fed to step (i).

20. The process of claim 10 wherein the organic phase containing dialkyl pyrophosphoric acid obtained in step (i) is fed to the organic extractant solution for extracting the lixiviation solution.

* * * * *